United States Patent [19]

Wong et al.

[11] Patent Number: 4,797,643

[45] Date of Patent: Jan. 10, 1989

[54] COAXIAL HYBRID COUPLER AND CROSSING ELEMENT

[75] Inventors: Mon N. Wong, Torrance; Samuel S. Wong, Lawndale, both of Calif.

[73] Assignee: Hughes Aircraft Company, Los Angeles, Calif.

[21] Appl. No.: 111,825

[22] Filed: Oct. 23, 1987

[51] Int. Cl.[4] ..... H01P 5/18

[52] U.S. Cl. ..... 333/115; 333/245

[58] Field of Search ..... 333/109, 115, 116

[56] References Cited

U.S. PATENT DOCUMENTS

| | | | |
|---|---|---|---|
| 3,626,332 | 12/1971 | Barbatoe | 333/116 |
| 3,654,570 | 4/1972 | Thomas | 333/115 |
| 4,532,484 | 7/1985 | Tajima et al. | 333/116 |
| 4,539,534 | 9/1985 | Hudspeth et al. | 333/115 |

*Primary Examiner*—Paul Gensler

*Attorney, Agent, or Firm*—S. M. Mitchell; M. J. Meltzer; A. W. Karambelas

[57] ABSTRACT

A microwave crossover by which an electromagnetic wave can crossover from one waveguide to another waveguide is formed completely within a planar structure having two hybrid couplers arranged in tandem with output ports of the first coupler connected to input ports of the second coupler. Each coupler is formed of an electrically conductive housing and two electrically conducting bars disposed therein and insulated therefrom. The bars are disposed in a common plane and are equally spaced from top and bottom walls of the housing. A central portion of each bar is angled relative to end portions of the bars to permit a crossing over of the bars at the central portions thereof. Each of the central portions is formed with a notch which engages with the notch of the other bar while maintaining a gap therefrom, the notches permitting the crossover to occur in the foregoing plane. Ends of the bars protrude through openings in the housing in the form of coaxial transmission lines. The crossing of the bars has the effect of a twist of central conductors of the coaxial lines resulting in a relocation of the ports of the coupler such that the two input ports are on an input side of the coupler, and two output ports are on an output side of the coupler. This arrangement of the ports permits the connection of two couplers in tandem to provide for the planar configuration of the microwave crossover.

42 Claims, 4 Drawing Sheets

COAXIAL HYBRID COUPLER AND CROSSING ELEMENT

This invention was made with government support under contract No. F04701-85-C-0067 awarded by the Air Force. The government has certain rights in this invention.

BACKGROUND OF THE INVENTION

Microwave circuits are employed for coupling electromagnetic energy between microwave components such as horns, circulators, signal generators and receivers. The conduits by which the electromagnetic energy is coupled between the microwave components may be constructed in various forms of transmission lines ranging from stripline to waveguide, and frequently include various forms of power couplers, power splitters, and power combiners. Such conduits allow microwave signals to be split among a number of microwave components, and also allow the combining of signals from a plurality of microwave components.

Of particular interest herein are complex microwave circuits employing coaxial transmission lines, particularly rigid coaxial transmission lines having a center conductor of rectangular or square cross section, for interconnecting numerous microwave components. Such circuitry is found, by way of example, in large antenna arrays employing many horn radiators coupled by signal combiners and/or splitters to produce a desired radiation pattern. In such complex microwave structures, it is frequently necessary to bring signals from various parts of the structure to other parts of the structure by coaxial lines which cross over each other. An example of such routing of signals is found in a matrix of interconnected signal paths such as a Butler matrix employed in converting a signal input at one port of the matrix to a set of signals outputted by the matrix for forming a beam. The crossings of signals in such matrix structures have been accomplished, heretofore, by bending one transmission line about another.

A problem arises in that the complexity and size of a microwave structure is increased by signal crossovers employing a bending of one coaxial transmission line about another. It is recognized that a simplified form of such a structure is attained by placing all components and connecting transmission lines in a single plane. However, a multiplicity of crossovers comprising bent transmission lines can produce a considerable amount of stacking of the transmission lines, one above the other. Such a mechanical configuration is both bulky and heavy. Excessive bulk and weight are characteristics which are to be avoided in the construction of antenna arrays, such as those employed in satellites, wherein a reduction in space and weight is most desirable.

SUMMARY OF THE INVENTION

The foregoing problem is overcome and other advantages are provided by a coaxial transmission-line crossover which, in accordance with the invention, can be constructed without necessitating any increased height to the crossover structure as compared to that of an individual coaxial line. This permits the microwave circuit to be constructed in a planar microwave configuration.

In accordance with the invention, an in-plane configuration for a microwave crossover is attained by connecting two hybrid couplers in tandem wherein each of the hybrid couplers divides the power of an incoming electromagnetic wave into two waves of equal power with a 90 degree phase shift between the two waves. Each of the hybrid couplers has two input ports and two output ports, the output ports of a first one of the two couplers being connected to the input ports of a second one of the two couplers.

The arrangement of the interconnection of the two couplers is accomplished by constructing all conduits of electromagnetic power within a single planar configuration, in accordance with a feature of the invention, by use of a coupler having two input ports on a front side of the coupler and two output ports on a back side of the coupler. Such a coupler is constructed by use of coaxial transmission lines connecting to the ports of the coupler and wherein, within a housing of the coupler, diametrically opposed pairs of input and output ports are connected by a pair of crossed insulated, electrically-conducting rods or bars which are spaced apart by a uniform narrow gap to provide for capacitive coupling of electromagnetic power between the two bars.

In accordance with yet another feature of the invention, an inplane configuration for the crossing of the two bars is attained by the construction of a notch in a central region of each bar, the notch of one bar facing the notch of the other bar at the site of the crossover with one notch engaging with and enveloping the other notch while maintaining a gap between the walls of the notch, through which gap there is capacitive coupling of electromagnetic power. The effect of the crossover has the effect of creating a half twist to the two bars, in a manner similar to a twisted pair of electrical conductors, this resulting in a relocation of one input port and one output port so as to place both input ports on the front side of the housing and both output ports on the back side of the housing.

Two embodiments of the crossed configuration of the pair of bars within a metallic housing are provided. In a first embodiment, each of the bars is provided with a pair of end portions which extend transversely to the housing, the end portions being joined by a central portion which is angled at approximately 45 degrees to offset the two end portions and to provide opportunity for the crossing of one central portion over the other central portion. The end portions of one bar are parallel to the corresponding end portions of the other bar to provide for capacitive coupling of electromagnetic power therebetween. A rectangularly shaped notch is provided in each of the central portions of sufficient size to provide for a desired gap width between the central portions in the crossover region for capacitive coupling of electromagnetic power between the central portions, which capacitive coupling per unit of length of a bar is substantially the same as the capacitive coupling per unit length of the bar at the end portions, thereby to minimize any tendency to develop reflected waves at the crossover. The overall length of the bars is approximately one-quarter wavelength of the radiation, with the central portion being less than one-tenth of a wavelength of the radiation.

In a second embodiment, both of the bars are replaced with bars having tapered extensions beyond the foregoing end portions, the extensions being inclined throughout their length, with a central portion parallel to the extensions and inclined to the two end portions. The resulting zig-zag configuration allows opposed end portions of the bars to be parallel to each other and to allow the crossing of one central portion over the other central portion. The notches in the central portions have a generally rectangular form with the end walls of the notches being stepped for increased bandwidth of the coupler. In addition, sections of sidewalls of the bars which face each other are angled relative to a central axis of the bar to establish a uniform gap width between these sidewall sections for a predetermined amount of capacitive coupling of electromagnetic radiation. In each bar, the central axis is parallel to each of the end portions, the end portions being offset to opposite sides of the central axis, while a narrow strip or isthmus of the central portion is parallel to and disposed on the central axis. This configuration of the bars increases the bandwidth of the coupler. Dielectric supports are positioned transversely of the housing on both sides of the crossed central regions, and a positional dielectric spacer is placed within each gap formed between opposed end portions on opposite sides of the engaging notches of the central portions. In both embodiments, the bars have a rectangular or square cross-sectional form.

BRIEF DESCRIPTION OF THE DRAWING

The aforementioned aspects and other features of the invention are explained in the following description, taken in connection with the accompanying drawing wherein.

DETAILED DESCRIPTION

Figure 1:
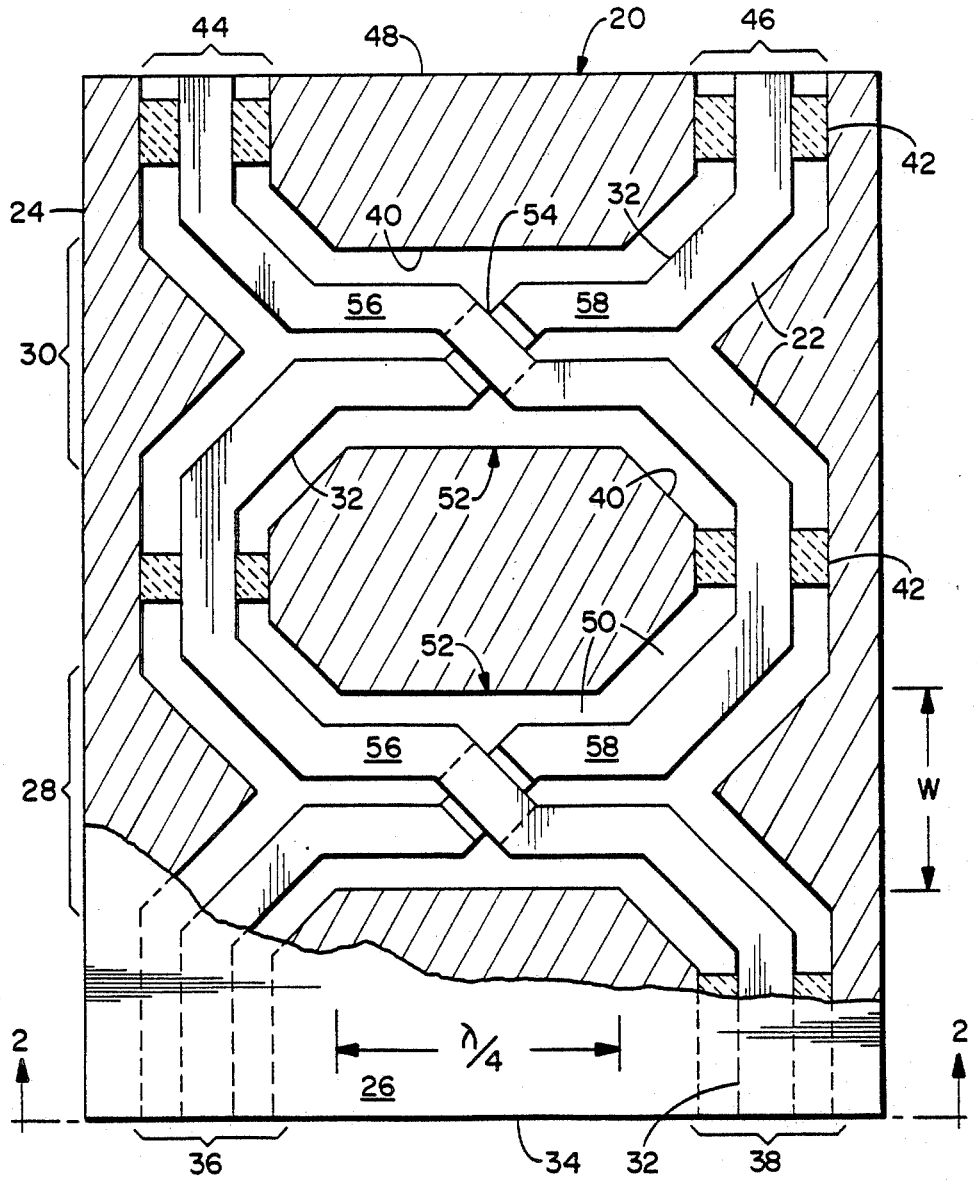
FIG. 1 is a plan view of the crossover of the invention formed within a planar configuration of a metallic base plate with a cover plate shown partially cutaway to expose the central conductors of coaxial transmission lines.
Figure 2:
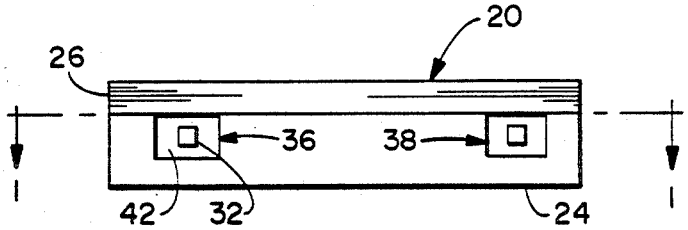
FIG. 2 is an end view of the crossover taken along the line 2—2 in FIG. 1.

FIGS. 1 and 2 show a crossover 20 formed of coaxial transmission lines 22 disposed within a base plate 24 covered by a cover plate 26. In accordance with the invention, the crossover 20 comprises two hybrid couplers 28 and 30 which are formed of crossed sections of a center conductor 32 of coaxial lines 22. FIG. 2 shows a front end 34 of the crossover 20, the view of FIG. 2 showing a first input port 36, a second input port 38, and the cover plate 26 disposed on top of the base plate 24. In FIG. 1, a portion of the cover plate 26 is shown, and the balance of the view is shown sectioned beneath the top surface of the base plate 24, as indicated in FIG. 2. The square cross section of center conductors 32, as well as the the square cross section of the inner surface of the outer conductor 40 of the transmission lines 22 are also shown in FIG. 2. It should be noted that, while the square cross sectional configuration of the transmission lines 22 is employed in the preferred embodiment of the invention, the teachings of the invention are applicable also to rectangular coaxial transmission lines. Dielectric supports 42 position the center conductors 32 within the outer conductors 40 and insulate the center conductors from the outer conductors. To facilitate the description in FIG. 1, only a few of the supports 42 are shown, it being understood that such supports may be positioned in various locations along the transmission lines, and may be given a well-known physical configuration which negates reflection of electromagnetic waves.

Each of the hybrid couplers 28 and 30 provide for a splitting of an electromagnetic wave into two waves of equal power, wherein the two waves differ in phase by 90 degrees. As will be explained herein, each of the couplers 28 and 30 are fabricated in accordance with a feature of the invention which provides that two input ports are located on a front end of each of the couplers, and two output ports are located on the back end of each of the couplers. By way of example, the two input ports to the coupler 28. A similar pair of output ports, namely, a first output port 44 and a second output port 46, are located at the back end 48 of the crossover 20. The output ports 44 and 46 also serve as output ports of the coupler 30. The couplers 28 and 30 are of identical construction.

As may be seen by the layout of the couplers 28 and 30 presented in FIG. 1, and by the end view presented in FIG. 2, the coaxial transmission lines 22 are fabricated in a convenient fashion by milling out channels 50 within the base plate 24 to provide the outer conductors 40 of the transmission lines 22. The center conductors 32 are then placed within the channels 50, and supported in their respective positions by the supports 42. Thereupon, the assembly is completed by installing the cover plate 26 on top of the base plate 24. Both the base plate 24 and the cover plate 26, as well as the center conductors 32, may be fabricated of an electrically conducting material which is readily machined, such as aluminum.

Figure 9:
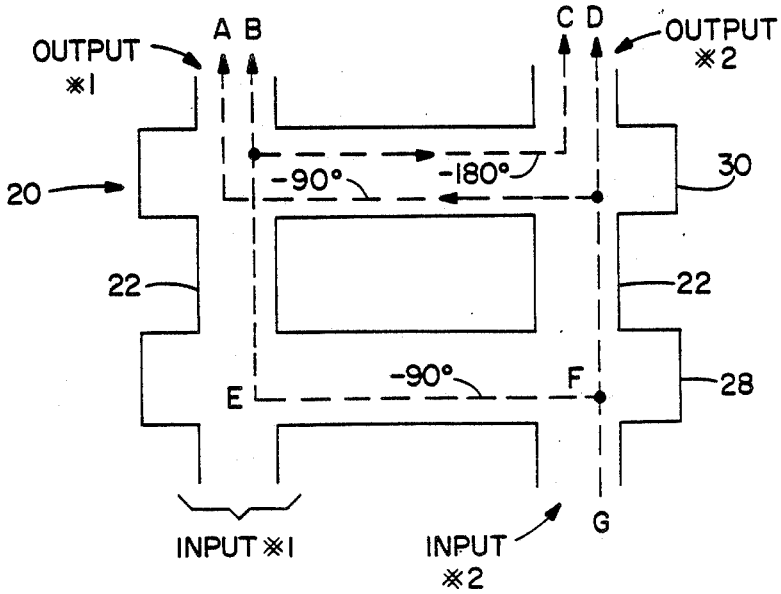
FIG. 9 is a diagrammatic representation of the tandem arrangement of the two couplers of FIG. 1 including paths of electromagnetic waves useful in explaining operation of the crossover.

As will be explained in further detail hereinafter with reference to FIG. 9, the crossover 20 acts to couple an electromagnetic wave from one of the input ports to the diagonally opposite output port, for example, from the second input port 38 to the first output port 44. This is accomplished by virtue of the even splitting of power at each of the couplers 28 and 30 with the phase lag of 90 degrees, this resulting in a cancellation of waves at one of the output ports so that all of the power of the input wave exists from the other output port.

It is noted that a particular feature of the invention is the construction of the crossover 20 including all components of the couplers 28 and 30 and their interconnecting transmission lines 22 within a single assembly of planar configuration. This is made possible because of the presence of both input ports of a coupler on the front end of the coupler, and the presence of both output ports on the back end of the coupler. This arrangement of the ports of each of the couplers 28 and 30 allows for the interconnection of the couplers via the transmission lines 22 as shown in the layout of FIG. 1, the layout disclosing that all connections are accomplished within a common planar configuration without the need for any transmission lines located outside of the assembly of FIG. 1. Both the plates 24 and 26 are of planar configuration and serve to form a housing of planar configuration for the coupler 28 and for the coupler 30.

These novel features are a direct consequence of the novel construction of each of the couplers 28 and 30, which construction will now be described in accordance with the invention.

With reference to FIGS. 1–5, the coupler 28 is formed with a central region 52 having a crossover 54 of two center conductors 32. Since both of the couplers 28 and 30 have identical construction, only the coupler 28 will be described in detail, it being understood that the description of the coupler 28 applies equally well to the coupler 30. In the central region 52, each of the center conductors 32 takes the form of a bar, there being two such bars 56 and 58 in the central region 52 and at the crossover 54. At the crossover 54, one bar crosses above the other bar which, by way of example, is portrayed in FIG. 3 by a crossing of the bar 56 above the bar 58.

Figure 4:
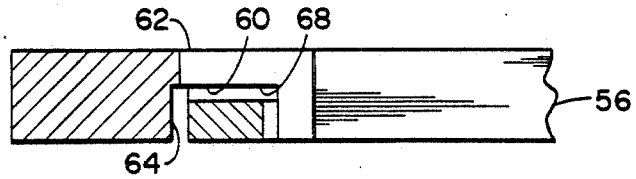
FIGS. 4 and 5 show sectional views taken along lines 4—4 and 5—5, respectively, in FIG. 3 to show details of bars in the crossover region of one of the couplers of the crossover.
Figure 5:
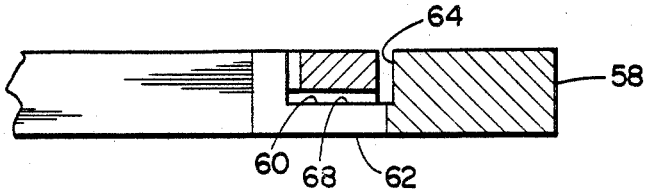

The crossover 54 is accomplished within the planar configuration by notching each of the bars 56 and 58 with notches 60 which face each other and allow the bars 56 and 58 to pass through each other at the notches 60 within the confines of the thickness of the bar 56 and the bar 58 as is shown in the side views of FIGS. 4 and 5. The notches 60 are sufficiently large to provide for clearance between the bars 56 and 58 at the crossover 54, the clearance maintaining electrical insulation between the two bars 56 and 58.

Figure 3:
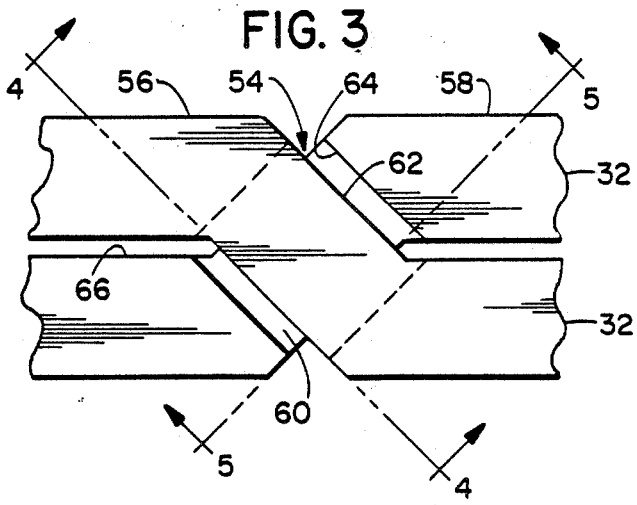
FIG. 3 is an enlarged plan view of a fragmentary portion of one of two hybrid couplers of the crossover of FIG. 1.

In FIG. 4, the bar 56 is shown to be notched at its bottom side, while FIG. 5 shows that the bar 58 is notched at its top side. As shown in FIGS. 1 and 3, the bars 56 and 58 are parallel to each other except at the crossover 54 where each of the bars undergoes a 45 degree change in direction so as to cross the other bar at an angle of 90 degrees. In each of the bars 56 and 58, the notch 60 is located at a crossing strip 62, the crossing strip 62 introducing a reverse curve to the bar by virtue of two turns of 45 degrees in opposite directions. The depth of each notch 60 is somewhat greater than the thickness of the rod 56, 58 so as to provide clearance in the vertical direction between the strips 62 of the two bars 56 and 58. Clearance is also provided in the horizontal (parallel to the plane of the base plate 24) direction between a strip 62 of one of the bars and the sides 64 of the notch 60 in the other of the two bars.

The clearance between the two crossing strips 62 at the central portions of the bars 56 and 58, and clearance between parallel end portions of the bars 56 and 58 are selected to produce a desired amount of capacitance for coupling electromagnetic power between the bars 56 and 58. At an operating frequency in the range of 3.7–4.2 GHz (gigahertz) wherein the free-space wavelength of the radiation has a nominal value of three inches, the clearance between the parallel end portions of the bars 56 and 58 is selected to define a gap 66 having a width of 30 mils. A larger clearance is provided at the crossover 54 such that the spacing between the crossing strips 62 as well as between a crossing strip 62 and sides 64 of a notch 66 are each equal to 50 mils. The larger clearance at the crossover 54 reduces the capacitance to the crossover 54 so as to equalize the amount of capacitance per unit length of the bar 56 or 58 throughout the length of the bar including both the end portion and the region of the crossover 54. It is noted that, in the absence of such increased clearance at the crossover 54, the added length of gap along the sides 64 of a notch plus the bottom 68 of a notch 60 tends to increase the amount of capacitance at the crossover 54. It is desired to maintain uniform capacitance in the central region 52 of the coupler 28 so as to minimize reflection of electromagnetic waves and insure a low value of VSWR (voltage standing wave ratio). The foregoing increase of clearance at the crossover 54 produces the desired reduction in the capacitance at the crossover 54 so as to equalize the capacitance per unit length of bar.

In terms of operation of the coupler 28, the configuration of the crossed bars 56 and 58 in FIG. 3 has the form of a twisted pair of electrical conductors wherein only one half twist is provided. Therefore, the two bars 56 and 58 may be viewed as a pair of parallel bars through which electromagnetic power is coupled. The location of input and output ports of the coupler 28 follows the twisting of the bars 56 and 58. In addition, the implementation of the twist, as is provided by the crossover 54 maintains electromagnetic coupling between the two bars 56 and 58 so that the desired amount of coupled power is maintained, independently of the twisting of the bars 56 and 58. Thereby, the coupler 28 can provide for a division of the electromagnetic power of a wave incident upon the coupler 28 into two waves of equal power outputted from the coupler 28 in substantially the same fashion as though the bars 56 and 58 were totally straight. Thus, by construction of the crossover 54 to implement a twisting of the bars 56 and 58, the effect in the operation of the coupler 28 is to interchange locations of input and output ports, in accordance with the invention, such that the two output ports are on the same side, namely the back side of the coupler 28 while the two input ports also share a common side, namely the front side of the coupler 28. This provides the coupler 28 with the requisite locations of input and output ports to allow the arrangement of interconnection between the two couplers 28 and 30 in a planar configuration as shown in FIG. 1.

It is also noted that, while the coupler 28 has been described for use with the crossover 20, the coupler 28 may also be employed in other microwave circuits for performing algebraic combinations of electromagnetic signals. Since the coupler 28 is reciprocal in its operation, it may be employed for both division of power in one wave among two other waves, as well as for combining the power of two waves into one wave. Also, the above noted gap width which has been established for a 3 dB coupling of power can be enlarged to provide for a coupling of smaller amounts of power. In the preferred embodiment of the invention, the following cross sectional dimensions of the transmission lines 22 are employed; the center conductor 32 in cross section measures 0.2 inches on a side, and the outer conductor 40 in cross section measures 0.5 inch on a side. The length of the bars 56 and 58, as portrayed in FIG. 1, is one-quarter wavelength of the electromagnetic energy propagating along the transmission lines 22. The width W (FIG. 1) of a channel 50 is enlarged at the coupler 28 to provide room for both of the center conductors 32, the width being increased by the width of one outer conductor 40. The form of electromagnetic wave propagating along a coaxial transmission line 22 is a TEM (transverse electromagnetic) wave. The impedance of a transmission line 22 is 50 ohms.

Figure 6:
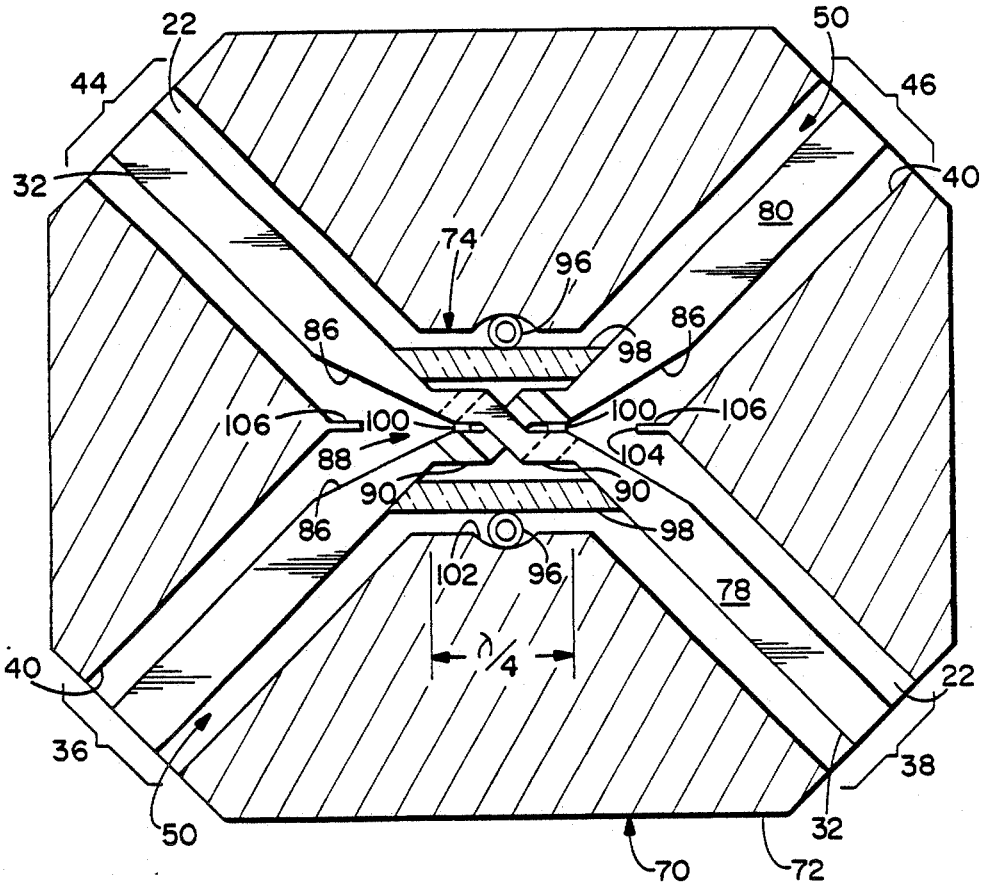
FIG. 6 is a view, similar to that of FIG. 3, showing an alternative embodiment of the crossover region of a coupler.

FIG. 6 shows a view of a hybrid coupler 70 which is an alternative embodiment of the hybrid coupler 28 of FIG. 1. The coupler 70 is fabricated in the same way as the coupler 28, and is formed of a base plate 72 in which channels 50 have been milled out to form the outer conductors 40 of coaxial transmission lines 22, the lines 22 including a center conductor 32, as was disclosed in the construction of the hybrid coupler 28 of FIG. 1. The view of FIG. 6 shows a layout of the components of the coupler 70 and has been formed by taking a section through the base plate 72 parallel to the top surface thereof, as was done in the sectioning of the view of FIG. 1.

In the event that the coupler 70 is to be employed in the construction of a microwave crossover circuit, such as the crossover 20 of FIG. 1, then the base plate 72 would be extended to include two of the couplers 70 with interconnecting transmission lines 22 in the same fashion as is disclosed for the construction of the crossover 20 of FIG. 1. The configuration of the base plate 72, as shown in FIG. 6, suffices for the creation of the two input ports 36 and 38, for each of the couplers 70 and the two output ports 44 and 46 for each of the two couplers 70. These ports may be employed for connection of the coupler 70 to various microwave circuits or components such as another hybrid coupler. As was the case with the coupler 28, the input ports 36 and 38 of the coupler 70 are directed towards the front of the coupler, while the output ports 44 and 46 of the couplers 70 are directed towards the back of the coupler. The cross sectional dimensions of the center conductor 32 and the outer conductor 40 in each of the transmission lines 22 are the same as that disclosed for the coupler 28 of FIG. 1. It should be noted that the description of the construction of the coupler 70, as well as of the coupler 28, can also be employed for coaxial transmission lines in which the center conductors have a nonrectangular cross-sectional shape such as a circular or elliptical shape. However, the rectangular shape is preferred for 3 dB couplers wherein an input wave divides into two output waves of equal power.

Figure 7:
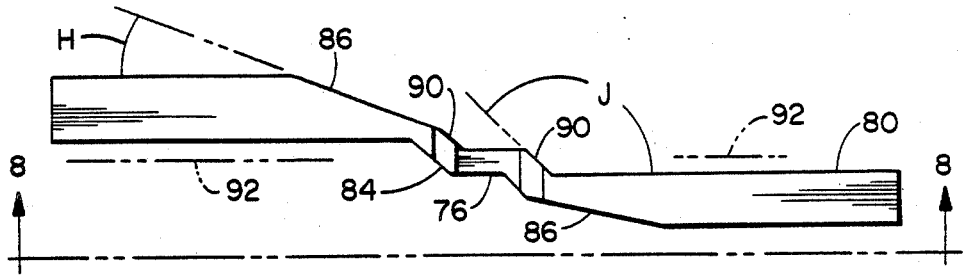
FIGS. 7 and 8 show, respectively, a plan view and a side view of a bar in the alternative embodiment of the coupler of FIG. 6.
Figure 8:
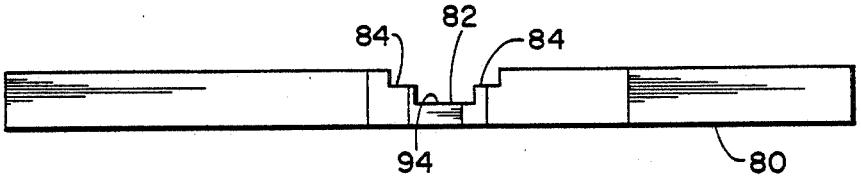

With reference to FIGS. 6, 7 and 8, the coupler 70 includes a central region 74 which differs from the central region 52 of the coupler 28 by the provision of a crossing strip 76 (FIG. 7) in each of two bars 78 and 80 which are narrower than the corresponding crossing strips 62 in the bars 56 and 58 of the coupler 28. The bars 78 and 80 of the coupler 70 (FIG. 6) correspond respectively to the bars 56 and 58 of the coupler 28 (FIGS. 1 and 3).

A further difference between the central region 74 and 52 is the provision in the central region 74 of a notch 82 in each of the bars 78 and 80 which has a stepped sidewall 84 (FIGS. 7 and 8) instead of the straight side 64 (FIGS. 3, 4, and 5) of the notch 60. Yet a further distinction between the central regions 74 and 52 is the inclusion at the edge of the central region 74 of a taper 86 (FIGS. 6 and 7) on extension or wing portions of the bars 78 and 80 approaching a crossover 88 (FIG. 6), such tapers being absent in the coupler 28 of FIG. 1. The foregoing differences in structure between the couplers 70 and 28 provide the coupler 70 with a better VSWR, and also increases the operating bandwidth of the coupler 70 as compared to the coupler 28.

As may be seen by inspection of FIGS. 6 and 1, the bars 78 and 80 have a more complex structure than the bars 56 and 58. It should be noted that the two bars 78 and 80 have the same physical shape, the geometry of the bar 80, as portrayed in FIG. 6, being obtained by turning the bar 78 upside down. Specific details in the construction of the bar 78 and 80 may be obtained by reference to the detailed views of the bar 80 in FIGS. 7 and 8. As the bar 80 extends inwardly from the extensions thereof, the width of the bar 80 is reduced by the taper 86 to a value of approximately one-half the original width such that the width of the crossing strip 76 is approximately 0.1 inch, as compared to 0.2 inches width at the ends of the bar 80. The crossing strip 76 is joined by necks 90 (FIG. 7) which are angled relative to the strip 76 so as to offset both extensions of the bar 80 on opposite sides of a central axis 92 of the bar 80. Both extensions of the bar 80, and the strip 76 are parallel to the axis 92, the strip 76 being centered on the axis 92. Inclination of a neck 90 relative to an extension of the bar 80 is shown in FIG. 7 by an angle J equal to 135 degrees. The inclination of both of the necks 90 to their respective bar extensions are the same. Inclination of a taper 86 relative to a straight edge of an extension of the bar 80 is shown in FIG. 7 by an angle H equal to 22.5 degrees. Both of the tapers 86 in the bar 80 have the same inclination.

The crossover 88 (FIG. 6) is similar to the crossover 54 (FIGS. 1 and 3) in that, in both cases, the crossing strip of one bar is enveloped by the notch of the the other bar. As may be seen in FIGS. 7 and 8, a bottom 94 of the notch 82 is sufficiently wide to extend beyond the side edges of the crossing strip 76 in the crossover 88 (FIG. 6). Steps of the stepped sidewalls 84 extend still further back from the sides of the crossing strip 76 in the crossover 88. Beyond the region of the crossover 88 and the necks 90, the bars 78 and 80 broaden to their initial width. Thus, the necks 90 and the crossing strip 76 can be viewed as an isthmus which joins the broader extensions or wing portions of each of the bars 78 and 80.

As shown in FIG. 6, the bars 78 and 80 are held in position by means of two springs 96, two dielectric supports 98, and a pair of dielectric spacers 100. The springs 96 are secured within pockets 102 in a sidewall of a channel 50. The springs urge the supports 98 towards each other and against the bars 78 and 80. The spacers 100 are oriented vertically with respect to the plane of the base plate 72 and are disposed between facing sides of paired necks 90, there being one spacer 100 on opposite sides of the crossover 88. The spacers 100 resist the forces exerted by the springs 96 as the bars 78 and 80 are urged together, thereby tightly holding the bars 78 and 80 in their respective positions for maintaining a desired clearance between the necks 90 of the bars 78 and 80, and between the corresponding portions of the crossing strips 76 and the notches 82 at the crossover 88. As was the case with gaps and spacings disclosed above with reference to the coupler 28, corresponding values are employed in the coupler 70 of FIG. 6. Thus, the spacers 100 have a thickness of 30 mils, and the vertical spacing between the bottom 94 of a notch 82 and the facing side of a crossing strip 76 is 50 mils. With respect to the dimensions of the steps of the stepped sidewall 84 (FIG. 8), the depth of the step is approximately one-third the depth of the bottom 94 of the notch 82, while the horizontal portion of the step is approximately one-third the width of the bottom 94. The length of the notch 82 in each of the bars 78 and 80 is less than one-tenth of the wavelength of an electromagnetic wave propagating through the coupler 70.

An iris 104 (FIG. 6) is provided by two vanes 106 extending inwardly towards the crossover 88 from outer sidewalls of channels 50, the vanes 106 being coplanar with the spacers 100. The iris 104 serves to limit the region through which electromagnetic power from an input port 36, 38 can couple to both of the output ports 44 and 46. The length of the foregoing isthmus (the two necks 90 plus the crossing strip 76) is one-quarter wavelength of the electromagnetic waves propagating along the transmission lines 22, this length being less than the cross-sectional dimension of the iris 104. In terms of the operation of the coupler 70, it is noted that the amount of power coupled between the bars 78 and 80 depends on the capacitance between the two bars, this being determined primarily by the coupling at the spacers 100 and at the crossover 88, while the difference in phase imparted between waves outputted at the ports 44 and 46 is determined by interaction of electromagnetic waves across the entire distance of the iris 104. The material employed in the supports 98 and the spacers 100 is preferably a plastic material having a dielectric constant of approximately 3.2, one such material being marketed by General Electric under the trade name of ULTEM 1000, this material being dimensionally stable, even at high temperatures.

Operation of the crossover 20 of FIG. 1 constructed with the hybrid couplers 28 and 30 is the same as the operation of the crossover 20 with two couplers 70 substituted for the couplers 28 and 30. This operation is explained with the aid of the diagrammatic representation of FIG. 9 which shows the two couplers 28 and 30 wherein output ports of the coupler 28 are connected via transmission lines 22 to corresponding input ports of the coupler 30. Also shown in FIG. 9 are the two input ports and the two output ports of the crossover 20. In this explanation of the operation, it is presumed that a wave enters the second input port at point G, and propagates along paths indicated by dashed lines. Key points on the dashed lines are indicated at E and F in the coupler 28, and four waves resulting by operation of the couplers 28 and 30 appear at points A, B, C, and D at the two output ports of the crossover 20.

In operation, the input wave at G splits at the coupler 28 into two waves E and F having equal power, which power is equal to one-half of the original power at G. The wave at E is shifted 90 degrees lagging relative to the wave at F. At the coupler 30, the wave E splits into two components B and C having equal power, the power in the wave components B and C each being equal to one-quarter of the input power at G. Similarly, the wave at F is split by the coupler 30 into two wave components A and D having equal power, the power in each of the waves A and D being equal to one-quarter of the power at G. The wave at C is shifted in phase by a lagging ninety degrees relative to the wave at B. Similarly, the wave at A is shifted in phase by a lagging 90 degrees relative to the wave at D. As a result of the phase shifting, the wave component at C has undergone two ninety-degree phase shifts for a total phase shift of 180 degrees. Therefore, the wave component C destructively interferes with the wave component D resulting in a cancellation of all power outputted at the second output port. Therefore, none of the power of the wave at E is coupled from the left side of the coupler 30 to the right side of the coupler 30; all of the power at E exits the first output port. Similarly, none of the power at F exits the second output port, all of the power being coupled from the right side of the coupler 30 to the left side of the coupler 30 to exit at the first output port. Since the coupling of power via the couplers 28 and 30 each introduce a lagging phase shift of 90 degrees, the contributions via both couplers 28 and 30 are in phase at the first output port, the two contributions at A and B each having a lagging phase shift of 90 degrees. Thus, the two contributions at A and B add cophasally to produce an output power at the first output port equal to the power inputted at the second input port. The wave outputted at the first output port has a lagging phase of ninety degrees relative to the phase of the wave inputted at the second input port.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A coaxial transmission-line crossing-element comprising:

a first hybrid coupler and a second hybrid coupler, each of said couplers having a first input port, a second input port, a first output port, and a second output port; and wherein said first output port of said first coupler is connected to said first input port of said second coupler, said second output port of said first coupler is connected to said second input port of said second coupler, said first and said second input ports of said first coupler serving as input ports of said crossing element, and said first and said second output ports of said second coupler serving as output ports of said crossing element; and wherein each of said couplers comprises:

a housing of electrically conductive material having a top wall and a bottom wall, there being a front wall, a back wall, a first sidewall and a second sidewall joining said top wall to said bottom wall, said housing having four openings oriented normally to a common plane, said top wall and said bottom wall being parallel to said common plane, said openings being positioned serially around a center of said housing and pointing outward in different directions;

center conductors disposed in each of said openings to form therewith said input ports and said output ports, said first input port and said first output port being located at opposite ends of said first sidewall, said second input port and said second output port being located at opposite ends of said second sidewall, said first input port and said second input port being located at opposite ends of said front wall, and said first output port and said second output port being located on opposite ends of said back wall;

a pair of bars electrically connecting ports of said first sidewall with ports of said second sidewall, said bars being uniformly positioned apart from each other and from an inner surface of said housing, a first bar of said pair of bars being twisted about a second bar of said pair of bars with a half twist to enable said first bar to interconnect said first input port with said second output port, and to enable said second bar to interconnect said second input port with said first output port; and wherein in each of said couplers, said half twist comprises a central portion of said first and of said second bars, in each of said bars said central portion having a notch, the notch of said first bar facing and interleaving the notch of said second bar.

2. A crossing element according to claim 1 wherein, in each of said couplers, each of said bars has a first end portion and a second end portion joined by said central portion, said first end portion and said second end portion being straight and of equal length, the sum of the lengths of the two end portions plus the central portion in each of said bars being approximately one-quarter wavelength of radiation propagating through said couplers.

3. A crossing element according to claim 1 wherein, in each of said couplers, each of said bars has a rectangular cross section and flat outer surfaces, one of said flat surfaces being planar throughout the length of said bar.

4. A crossing element according to claim 3 wherein, in each of said couplers, said one flat surface of one of said bars is parallel to said one flat surface of the other of said bars, said half twist retaining the planar configuration of said one flat surface in each of said bars.

5. A coaxial transmission-line crossing-element comprising:

a first hybrid coupler and a second hybrid coupler, each of said couplers having a first input port, a second input port, a first output port, and a second output port; and wherein said first output port of said first coupler is connected to said first input port of said second coupler, said second output port of said first coupler is connected to said second input port of said second coupler, said first and said second input ports of said first coupler serving as input ports of said crossing element, and said first and said second output ports of said second coupler serving as output ports of said crossing element; and wherein each of said couplers comprises:

a housing of electrically conductive material having a top wall and a bottom wall, there being a front wall, a back wall, a first sidewall and a second sidewall joining said top wall to said bottom wall, said housing having four openings oriented normally to a common plane, said top wall and said bottom wall being parallel to said common plane, said openings being positioned serially around a center of said housing and pointing outward in different directions;

center conductors disposed in each of said openings to form therewith said input ports and said output ports, said first input port and said first output port being located at opposite ends of said first sidewall, said second input port and said second output port being located at opposite ends of said second sidewall, said first input port and said second input port being located at opposite ends of said front wall, and said first output port and said second output port being located on opposite ends of said back wall;

a pair of bars electrically connecting ports of said first sidewall with ports of said second sidewall, said bars being uniformly positioned apart from each other and from an inner surface of said housing, a first bar of said pair of bars being twisted about a second bar of said pair of bars with a half twist to enable said first bar to interconnect said first input port with said second output port, and to enable said second bar to interconnect said second input port with said first output port; and wherein, in each of said couplers, each of said bars has a central portion, and a first end portion and a second end portion joined by said central portion, said first end portion and said second end portion being straight and of equal length, said half twist comprising the central portions of said first and said second bar;

in each of said couplers, each of said bars has a rectangular cross section and flat outer surfaces, one of said flat surfaces being planar throughout the length of said bar, the sum of the lengths of the two end portions plus the central portion in each of said bars being approximately one-quarter wavelength of radiation propagating through said couplers;

in each of said couplers, said one flat surface of one of said bars is parallel to said one flat surface of the other of said bars, said half twist retaining the planar configuration of said one flat surface in each of said bars; and in each of said couplers, said half twist comprises the central portion of said first and said second bars, in each of said bars said central portions having a notch opposite said one planar surface, the notch of said first bar facing and interleaving the notch of said second bar.

6. A crossing element according to claim 5 wherein, in each of said couplers, end portions of each bar are parallel to the front wall and the back wall of said housing.

7. A crossing element according to claim 6 wherein, in each of said couplers and in each bar, said central portion is angled relative to first and said second end portions of the bar to permit an interleaving and crossing configuration of the central portions of said first and said second bars of a coupler.

8. A crossing element according to claim 7 wherein, in each of said couplers, there is capacitance between said first bar and said second bar for coupling an electromagnetic wave between said first bar and said second bar, the capacitance per unit length of an end portion of a bar being established by a clearance between end portions of said first and said second bars, and wherein the clearance between central portions of said bars in the notches of said central portions is enlarged relative to the clearance between said end portions of said bars to provide for a capacitance per unit length of said central portions of said bars substantially equal to the capacitance per unit length of the end portions of said bars, thereby to inhibit the formation of reflected waves of electromagnetic power.

9. In a crossing element according to claim 5 wherein, in each of said couplers, each bar has a first and a second extension beyond said first and said second end portions, respectively, the central portion being parallel to a central longitudinal axis, the two extensions of the bar being parallel to and offset to opposite sides of said axis, the axes of the two bars being angled to provide for a crossover of the central portions of each of said bars.

10. A crossing element according to claim 9 wherein, in each of said couplers, and in each bar of a coupler, said one flat surface is parallel to said bottom wall, and each bar has opposing sidewalls intersecting said one flat surface, sections of the sidewalls on opposite sides of the central portion in said first bar facing corresponding sidewall sections of said second bar being angled relative to said central axis of said first bar.

11. A crossing element according to claim 10 wherein, in each of said couplers, corresponding sidewall sections of the extensions of said second bar are angled to the central axis of said second bar equally with a corresponding sidewall section angulation of the extensions of said first bar, the sum of angulations of the sidewall sections of said first and said second bars being equal to approximately half a crossing angle of axes of said first and said second bars, thereby to provide a taper to said extensions of said bars.

12. A crossing element according to claim 11 wherein, in each of said couplers, each notch is a double stepped notch.

13. A crossing element according to claim 12 wherein, in each of said couplers, and in each bar of a coupler, the central portion is narrowed relative to the extensions of the bar by angulation of the sidewall sections relative to the central axis, the narrowing of the central portion producing an isthmus of smaller cross section than said extensions.

14. A crossing element according to claim 13 wherein, in each of said couplers, said housing includes an iris comprising vanes extending from sidewalls of the housing between the extensions of said first and said second bars.

15. A crossing element according to claim 14 wherein each of said couplers includes a dielectric spacer disposed between opposed end portions on opposite sides of a gap formed by the notches of said first and said second bars.

16. A crossing element according to claim 15 wherein each of said couplers further comprises a front dielectric support disposed between said front wall and end portions of each of said bars, and a back dielectric support disposed between said back wall and end portions of each of said bars.

17. A crossing element according to claim 9 wherein, in each of said couplers, each notch is a double stepped notch.

18. A crossing element according to claim 10 wherein, in each of said couplers, and in each bar of a coupler, the central portion is narrowed relative to the extensions of the bar by angulation of the sidewall sections relative to the central axis, the narrowing of the central portion producing an isthmus of smaller cross section than said extensions.

19. A crossing element according to claim 10 wherein, in each of said couplers, said housing includes an iris comprising vanes extending from sidewalls of the housing between the extensions of said first and said second bars.

20. A coupler for electromagnetic power comprising:

a housing of electrically conductive material having a top wall and a bottom wall, there being a front wall, a back wall, a first sidewall and a second sidewall joining said top wall to said bottom wall, said housing having four openings oriented normally to a common plane, said top wall and said bottom wall being parallel to said common plane, said openings being positioned serially around a center of said housing and pointing outward in different directions;

center conductors disposed in each of said openings to form therewith a first input port and a second input port and a first output port and second output port, said first input port and said first output port being located at opposite ends of said first sidewall, said second input port and said second output port being located at opposite ends of said second sidewall, said first input port and said second input port being located at opposite ends of said front wall, and said first output port and said second output port being located on opposite ends of said back wall;

a pair of bars electrically connecting ports of said first sidewall with ports of said second sidewall, said bars being uniformly positioned apart from each other and from an inner surface of said housing, a first bar of said pair of bars being twisted about a second bar of said pair of bars with a half twist to enable said first bar to interconnect said first input port with said second output port, and to enable said second bar to interconnect said second input port with said first output port; and wherein said half twist comprises a central portion of said first and of said second bars, in each of said bars said central portion having a notch, the notch of said first bar facing and interleaving the notch of said second bar.

21. A coupler according to claim 20 wherein each of said bars has a first end portion and a second end portion joined by said central portion, said first end portion and said second end portion being straight and of equal length, the sum of the lengths of the two end portions plus the central portion in each of said bars being approximately one-quarter wavelength of radiation propagating through said couplers.

22. A coupler according to claim 20 wherein each of said bars has a rectangular cross section and flat outer surfaces, one of said flat surfaces being planar throughout the length of said bar.

23. A coupler according to claim 22 wherein said one flat surface of one of said bars is parallel to said one flat surface of the other of said bars, said half twist retaining the planar configuration of said one flat surface in each of said bars.

24. A coupler for electromagnetic power comprising:

a housing of electrically conductive material having a top wall and a bottom wall, there being a front wall, a back wall, a first sidewall and a second sidewall joining said top wall to said bottom wall, said housing having four openings oriented normally to a common plane, said top wall and said bottom wall being parallel to said common plane, said openings being positioned serially around a center of said housing and pointing outward in different directions;

center conductors disposed in each of said openings to form therewith a first input port and a second input port and a first output port and second output port, said first input port and said first output port being located at opposite ends of said first sidewall, said second input port and said second output port being located at opposite ends of said second sidewall, said first input port and said second input port being located at opposite ends of said front wall, and said first output port and said second output port being located on opposite ends of said back wall;

a pair of bars electrically connecting ports of said first sidewall with ports of said second sidewall, said bars being uniformly positioned apart from each other and from an inner surface of said housing, a first bar of said pair of bars being twisted about a second bar of said pair of bars with a half twist to enable said first bar to interconnect said first input port with said second output port, and to enable said second bar to interconnect said second input port with said first output port; and wherein in each of said couplers, each of said bars has a central portion, and a first end portion and a second end portion joined by said central portion, said first end portion and said second end portion being straight and of equal length, said half twist comprising the central portions of said first and said second bars;

in each of said couplers, each of said bars has a rectangular cross section and flat outer surfaces, one of said flat surfaces being planar throughout the length of said bar, the sum of the lengths of the two end portions plus the central portion in each of said bars being approximately one-quarter wavelength of radiation propagating through said couplers;

in each of said couplers, said one flat surface of one of said bars is parallel to said one flat surface of the other of said bars, said half twist retaining the planar configuration of said one flat surface in each of said bars; and in each of said couplers, said half twist comprises the central portion of said first and said second bars, in each of said bars said central portions having a notch opposite said one planar surface, the notch of said first bar facing and interleaving the notch of said second bar.

25. A coupler according to claim 24 wherein end portions of each bar are parallel to the front wall and the back wall of said housing.

26. A coupler according to claim 25 wherein in each bar, said central portion is angled relative to first and said second end portions of the bar to permit an interleaving and crossing configuration of the central portions of said first and said second bars of a coupler.

27. A coupler according to claim 26 wherein there is capacitance between said first bar and said second bar for coupling an electromagnetic wave between said first bar and said second bar, the capacitance per unit length of an end portion of a bar being established by a clearance between end portions of said first and said second bars, and wherein the clearance between central portions of said bars in the notches of said central portions is enlarged relative to the clearance between said end portions of said bars to provide for a capacitance per unit length of said central portions of said bars substantially equal to the capacitance per unit length of the end portions of said bars, thereby to inhibit the formation of reflected waves of electromagnetic power.

28. A coupler according to claim 24 wherein each bar has a first and a second extension beyond said first and said second end portions, respectively, the central portion being parallel to a central longitudinal axis, the two extensions of the bar being parallel to and offset to opposite sides of said axis, the axes of the two bars being angled to provide for a crossover of the central portions of each of said bars.

29. A coupler according to claim 28 wherein in each bar, said one flat surface is parallel to said bottom wall, and each bar has opposing sidewalls intersecting said one flat surface, sections of the sidewalls on opposite sides of the central portion in said first bar facing corresponding sidewall sections of said second bar being angled relative to said central axis of said first bar.

30. A coupler according to claim 29 wherein corresponding sidewall sections of the extensions of said second bar are angled to the central axis of said second bar equally with a corresponding sidewall section angulation of the extensions of said first bar, the sum of angulations of the sidewall sections of said first and said second bars being equal to approximately half a crossing angle of axes of said first and said second bars, thereby to provide a taper to said extensions of said bars.

31. A coupler according to claim 30 wherein each notch is a double stepped notch.

32. A coupler according to claim 31 wherein in each bar the central portion is narrowed relative to the extensions of the bar by angulation of the sidewall sections relative to the central axis, the narrowing of the central portion producing an isthmus of smaller cross section than said extensions.

33. A coupler according to claim 32 wherein said housing includes an iris comprising vanes extending from sidewalls of the housing between the end portions of said first and said second bars.

34. A coupler according to claim 33 further comprising a dielectric spacer disposed between opposed end portions on opposite sides of a gap formed by the notches of said first and said second bars.

35. A coupler according to claim 34 further comprising a front dielectric support disposed between said front wall and end portions of each of said bars, and a back dielectric support disposed between said back wall and end portions of each of said bars.

36. A coupler according to claim 28 wherein each notch is a double stepped notch.

37. A coupler according to claim 29 wherein in each bar the central portion is narrowed relative to the extensions of the bar by angulation of the sidewall sections relative to the central axis, the narrowing of the central portion producing an isthmus of smaller cross section than said extensions.

38. A coupler according to claim 29 wherein said housing includes an iris comprising vanes extending from sidewalls of the housing between the extensions of said first and said second bars.

39. A coupler according to claim 24 wherein the length of each of said notches is less than one-tenth of the wavelength of an electromagnetic wave propagating through the coupler.

40. A coupler according to claim 24 wherein said notches of the central portion of each of said bars envelop each other to a sufficient depth to provide for an in-plane crossing of an electromagnetic wave propagating through the coupler.

41. A coupler according to claim 24 further comprising means for supporting each of said bars within said housing and insulated from each other and from said housing.

42. A coupler according to claim 30 wherein an extension of said first bar is angled relative to the opposed extension of said second bar by an angle of 90 degrees.

* * * * *